US007673915B1

(12) United States Patent
Fischer

(10) Patent No.: US 7,673,915 B1
(45) Date of Patent: Mar. 9, 2010

(54) COIL HANDLING ASSEMBLY

(76) Inventor: Bert M. Fischer, 405 Biltmore, Fenton, MO (US) 63026

( * ) Notice: Subject to any disclaimer, the term of this patent is extended or adjusted under 35 U.S.C. 154(b) by 906 days.

(21) Appl. No.: 11/347,496

(22) Filed: Feb. 3, 2006

Related U.S. Application Data

(60) Provisional application No. 60/650,370, filed on Feb. 4, 2005.

(51) Int. Cl.
*B66C 1/54* (2006.01)
*B66F 9/18* (2006.01)

(52) U.S. Cl. ..... 294/86.4; 414/607; 414/620

(58) Field of Classification Search ..... 294/86.4, 294/93; 414/607, 620, 910, 911; 242/571.4, 242/559.1
See application file for complete search history.

(56) References Cited

U.S. PATENT DOCUMENTS 3,134,620 A * 5/1964 Blaisdell ..... 294/93
4,687,244 A * 8/1987 Cullen et al. ..... 294/86.41
5,143,507 A * 9/1992 Haugen et al. ..... 294/93
6,174,125 B1 * 1/2001 Davis et al. ..... 294/93

* cited by examiner

*Primary Examiner*—Paul T Chin
(74) *Attorney, Agent, or Firm*—Husch Blackwell Sanders LLP

(57) ABSTRACT

An improved coil handling assembly and method of manufacture comprising a cylindrical support member having end covers and one or more stabilizing members. The assembly is capable of accepting a fork lift fork whereby a material coil or roll may be lifted or moved. The assembly further comprises adjustable front and rear coil stabilizers which are moveable and removable whereby a plurality of coil or roll sizes may be contained, stored, transported, or utilized on a processing line. Unlike prior art coil handling equipment, the present art provides a quick, convenient, and safe apparatus and method for working with or utilizing coiled materials.

20 Claims, 15 Drawing Sheets

COIL HANDLING ASSEMBLY

This application claims priority of U.S. Provisional Patent Application No. 60/650,370, filed Feb. 4, 2005, entitled Improved Coil Handling Assembly.

BACKGROUND OF THE INVENTION

The art of the present invention relates to coil handling assemblies for securing rolls or coils of sheet material in a cradle-like manner. More particularly, the present art cradles sheet material coils such that once a coil is secured to the assembly, the assembly and the attached coil can simply be transported to a processing line and the sheet material unwound from the assembly for processing. This type of coil handling assembly is typically used for processing sheet metal in the HVAC industry although the present invention can conceivably be utilized in other industries employing coiled material, either metallic or non-metallic.

Coiled sheet metal as typically utilized in the metal processing industry consists of a continuous coiled roll or 'coil,' which during an earlier processing step was initially wound around a mandrel until the desired quantity or lineal feet of sheet metal was obtained. Subsequently, the coil was removed from the mandrel leaving a center opening in the coil which extends completely through the wound coil from a front edge of the coil to a back edge of the coil. The diameter of the center opening corresponds with the diameter of the mandrel from which it was removed and the length or depth of the center opening corresponds with the width of the sheet metal itself. The standard center opening of coiled sheet metal with a material thickness typically used in the HVAC industry has a diameter of approximately 20 (twenty) to 24 (twenty-four) inches. This center opening in the coil is commonly referred to as the inner diameter (or ID) of the coil. The center opening or coil ID is used whenever the coil is subsequently handled, either for transport and/or for further processing.

The improved coil handling assembly of the present invention first comprises a cylindrical support member capable of supporting the coiled material across the entire width of the coil. The cylindrical support member has a front end, a back end, and a shaft extending from both the front end and the back end. Preferably a front bearing/support assembly is attached to or with a front end extension of the shaft and a back bearing/support assembly is attached to or with a back end extension of the shaft. The cylindrical support member further has a moveable front and back coil stabilizer. Preferably, the front and back coil stabilizers each have a retainer plate with a center aperture capable of receiving the cylindrical support member and a clamping member having a circumferential band and a fastening means or a clamping member having a circumferential band in combination with a fastening means. The clamping member is preferably at least partially attached to the retainer plate such that the clamping member is capable of receiving the cylindrical support member and the fastening means is capable of tightening and/or loosening the clamping member with respect to the cylindrical support member such that both the front and back coil stabilizers can be removably attached and secured to the cylindrical support member.

With the commercially manufactured prior art, the wound coil is not supported along its entire width but is merely supported along the coil's front edge and the coil's back edge with a front hub/front bearing assembly and a back hub/back bearing assembly intermediately connected with a shaft passing through the coil's ID.

With all of the prior art coil handling devices, at least one of the hub/bearing assemblies must be disconnected from the shaft and removed in order to load another coil into the coil handling device. With applicant's improved coil handling assembly, the only part or portion requiring removal for reloading another coil, is one of the coil stabilizers, each of which easily slide off of the cylindrical support member. Applicant's cylindrical support member also has a diameter less than the diameter of the center opening of the wound coil (e.g. ID less than twenty inches) which assures that the coil center of gravity is below the shaft centerline. Since the shaft/bearing assemblies of applicant's improved coil handling assembly are integral to the cylindrical support member unit which easily slides through the coil's ID, said assemblies do not require removal to load or unload a coil. Less modification or changeover to the coil handling equipment results in significant time savings and greater manufacturing efficiencies in the processing line. It is estimated that applicant's improved coil handling assembly reduces coil loading time by approximately 83% over the existing prior art coil handling devices.

The improved coil handling assembly of the present invention also allows for the handling of coils with irregular or egg-shaped ID's. The cylindrical support member of applicant's improved coil handling assembly is capable of supporting the coiled material across the entire width of the coil even though the diameter of the cylindrical support member is less than the diameter of the coil ID. The smaller diameter of the cylindrical support member allows the cylindrical support member to be easily received within irregular shaped center openings (ID) of a wound coil. Prior art alternatives which support the coil only on the edges of the coil's ID require a substantially symmetrical coil ID of a uniform diameter.

Also, the improved coil handling assembly of applicant's invention can be used with any coil width, such as smaller slit coil multiples. Since the coil stabilizers are slidable along the cylindrical support member until completely flush with one another, the present art allows for infinite width accommodation up to the length of the cylindrical support member. The hub/bearing assemblies of the prior art alternatives have significant depth to the hub/bearing assemblies themselves such that said prior art are not fully adjustable. That is, unlike the present art, the prior art assemblies cannot be adjusted flush with one another and therefore have a minimum coil width restriction in addition to a maximum coil width restriction.

Furthermore, the present art improved coil handling assembly minimizes unintentional unwinding or free spooling of the coil when the coil is attached to the improved coil handling assembly. That is, since the unique cylindrical support member actually lowers the coil's center of gravity while supporting the coil's weight, the coils ability to free spool is minimized.

Still further, the present invention provides an improved coil handling assembly capable of being edge guided, center guided, and/or multiple position guided for essentially unlimited guide positions and therefore maximum flexibility on various processing lines. Additionally, the improved coil handling assembly provides for the coil to be over wound or under wound during processing.

The preferred embodiment of the improved coil handling assembly of the present invention comprises a cylindrical support member capable of being at least partially received within the coil's ID and extending through the coil's ID from the coil's front edge to the coil's back edge such that the cylindrical support member is capable of providing support to the coiled material across the entire width of the coil itself.

Accordingly, it is an object of the present invention to provide an improved coil handling assembly and method of manufacture which provides a coil support along the entire coil width and not simply the coil ID edges.

Another object of the present invention is to provide an improved coil handling assembly and method of manufacture which minimizes the labor and time requirements for loading and unloading coils.

A further object of the present invention is to provide an improved coil handling assembly and method of manufacture which handles coils having an irregular shaped ID.

A still further object of the present invention is to provide an improved coil handling assembly and method of manufacture which is adaptable to most any width coil.

A yet further object of the present invention is to provide an improved coil handling assembly and method of manufacture which minimizes coil free spooling and provides maximum flexibility on various processing lines.

SUMMARY OF THE INVENTION

The art of the present invention comprises a new and improved coil handling assembly having unique sizing, adjustability, construction, and utilization attributes which allow for quick and easy handling of coiled sheet metal. The improved coil handling assembly of the present invention comprises a cylindrical support member capable of supporting the coiled material across the entire width of the coil. The cylindrical support member has a front end, a back end, and preferably a shaft extending from both the front end and the back end with preferably a front bearing/support assembly attached to a front end extension of the shaft and a back bearing/support assembly attached to a back end extension of the shaft.

Two coil stabilizers, a front and a back coil stabilizer, are utilized in the preferred embodiment to hold the coiled material. Preferably, the front and back coil stabilizers each have a retainer plate with an aperture in the center capable of receiving the cylindrical support member and a clamping member having a circumferential band and a fastening means or a clamping member having a circumferential band in combination with a fastening means. The clamping member is preferably at least partially attached to the retainer plate such that the clamping member is capable of receiving the cylindrical support member and the fastening means is capable of tightening and/or loosening the clamping member with respect to the cylindrical support member such that both the front and back coil stabilizers can be removably attached and secured to the cylindrical support member.

In the preferred embodiment, the cylindrical support member has a front end, a back end opposite the front end, a middle portion intermediate the front end and the back end, a center circular opening extending completely through the cylindrical support member from the front end to the back end, the middle portion further having an outer surface and an inner surface adjacent the center circular opening. The cylindrical support member also comprises a front end cover having a center aperture, the front end cover attached to the front end of the cylindrical support member, and a back end cover having a center aperture, the back end cover attached to the back end of the cylindrical support member. In the preferred embodiment, the shaft extending from the front end and the back end of the cylindrical support member has one or more drive shafts comprising a square or other cross section for connection with a processing line motor assembly.

The improved coil handling assembly is typically manufactured from tubular, plate, and bar stock carbon steel but may be manufactured from a plurality of other materials including but not limited to stainless steel, aluminum, titanium, composites, ceramics, and polymers.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
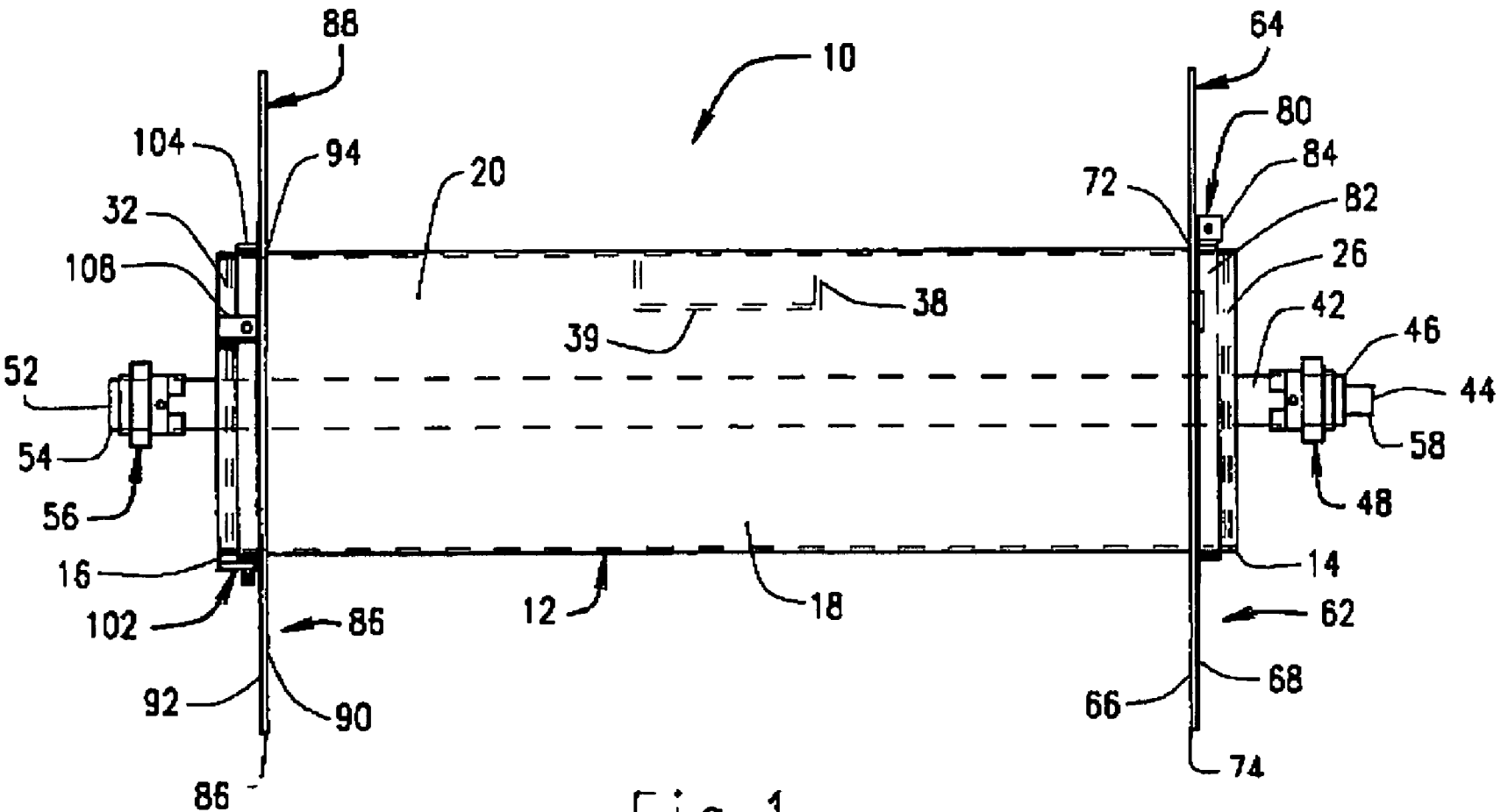
FIG. 1 is a side plan view of the preferred embodiment of the improved coil handling assembly.
Figure 3:
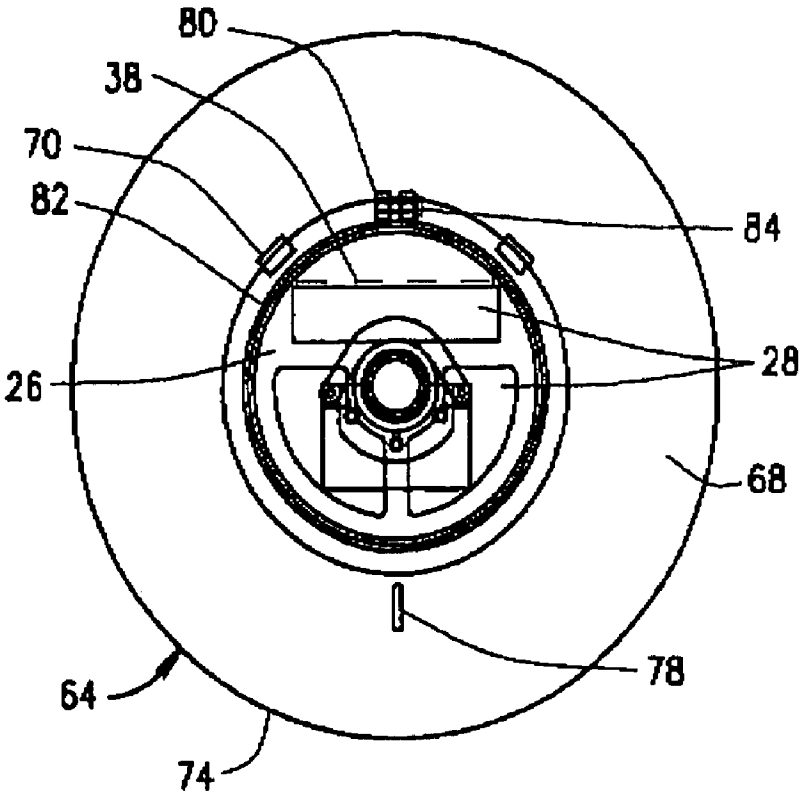
FIG. 3 is a front end plan view of the preferred embodiment.
Figure 2:
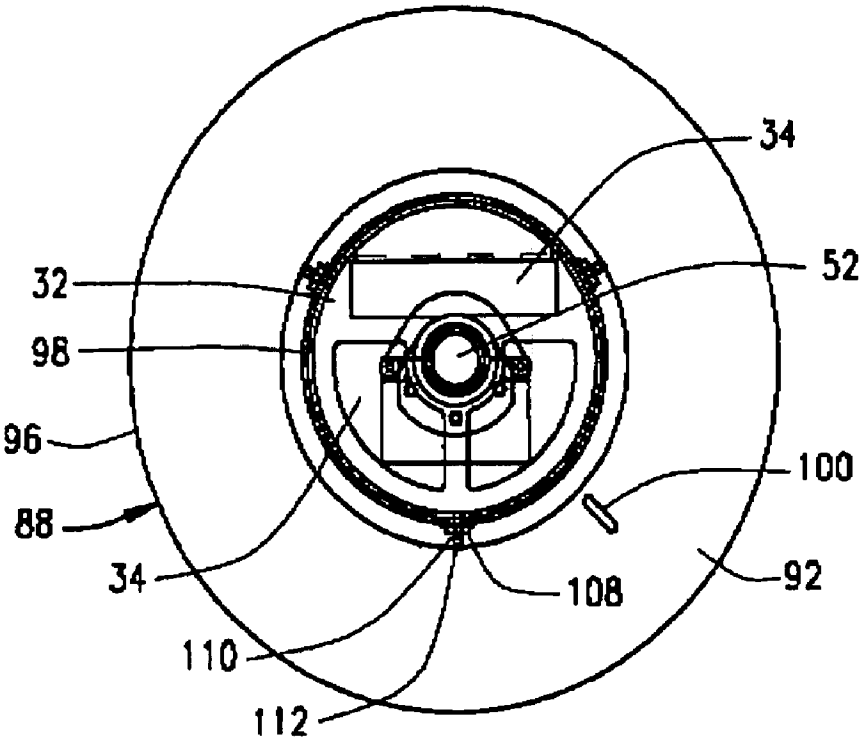
FIG. 2 is a back end plan view of the preferred embodiment.
Figure 4:
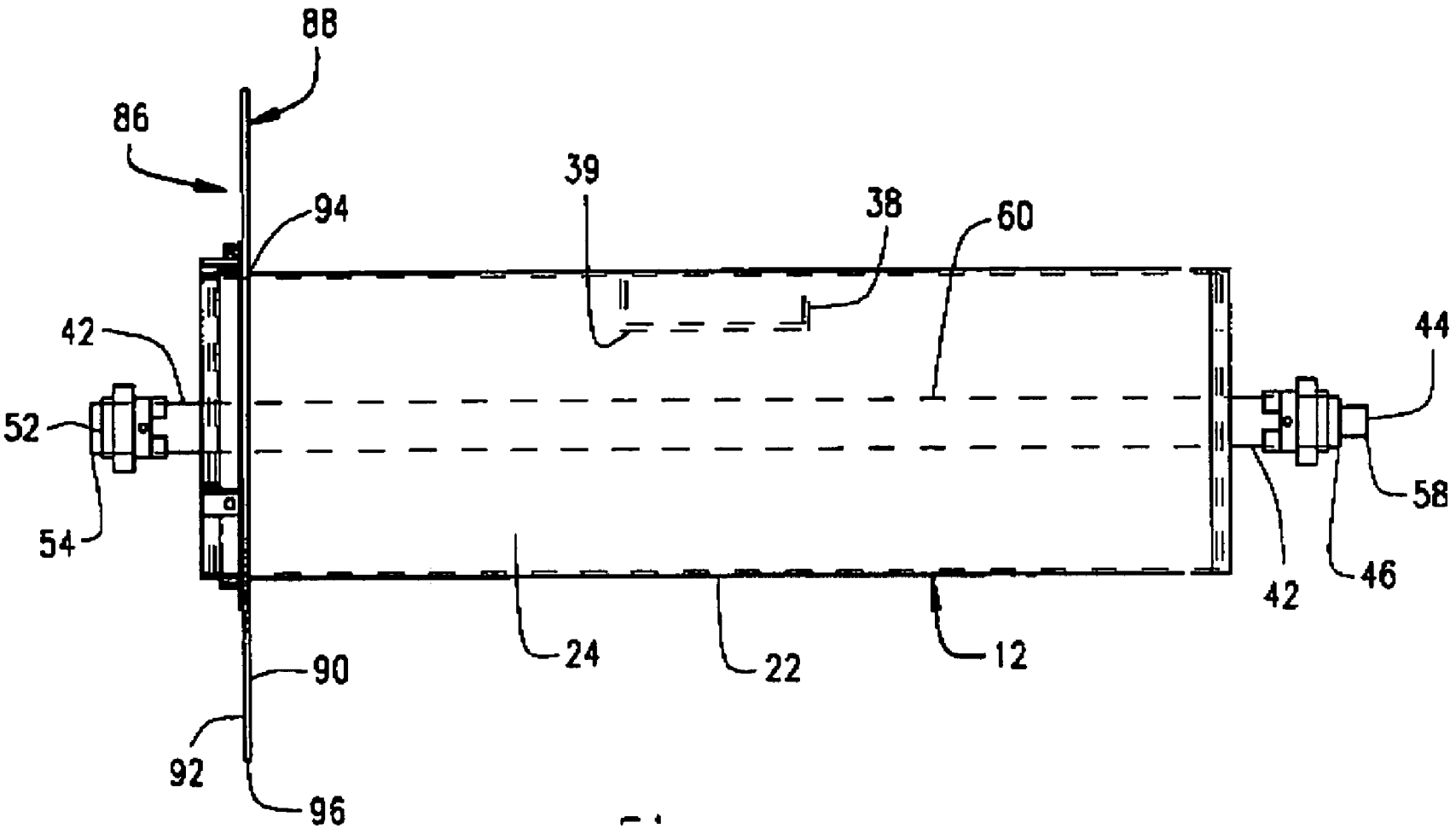
FIG. 4 is a side plan view of the preferred embodiment shown without the front coil stabilizer.
Figure 5:
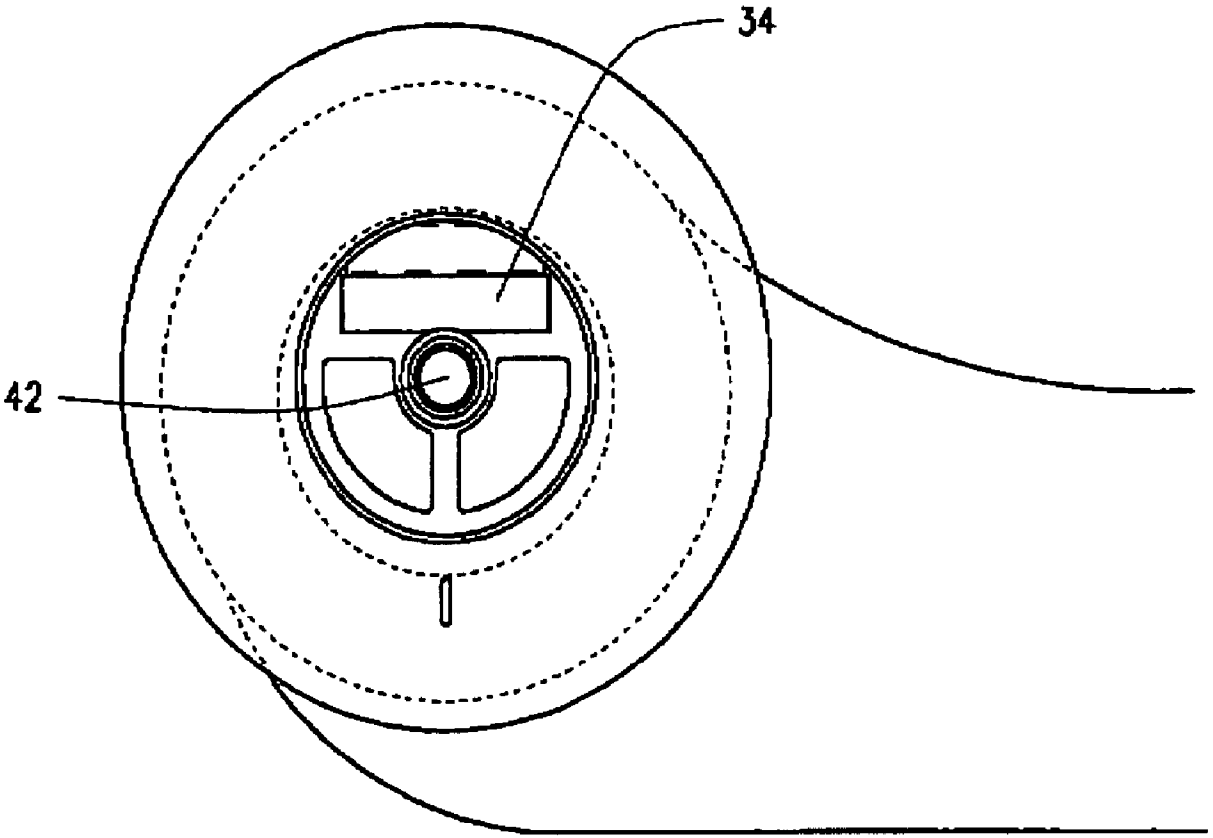
FIG. 5 is another front plan view of the preferred embodiment shown supporting a coil and further illustrating the lowered center of gravity of the coil when supported by the improved coil handling assembly.
Figure 6:
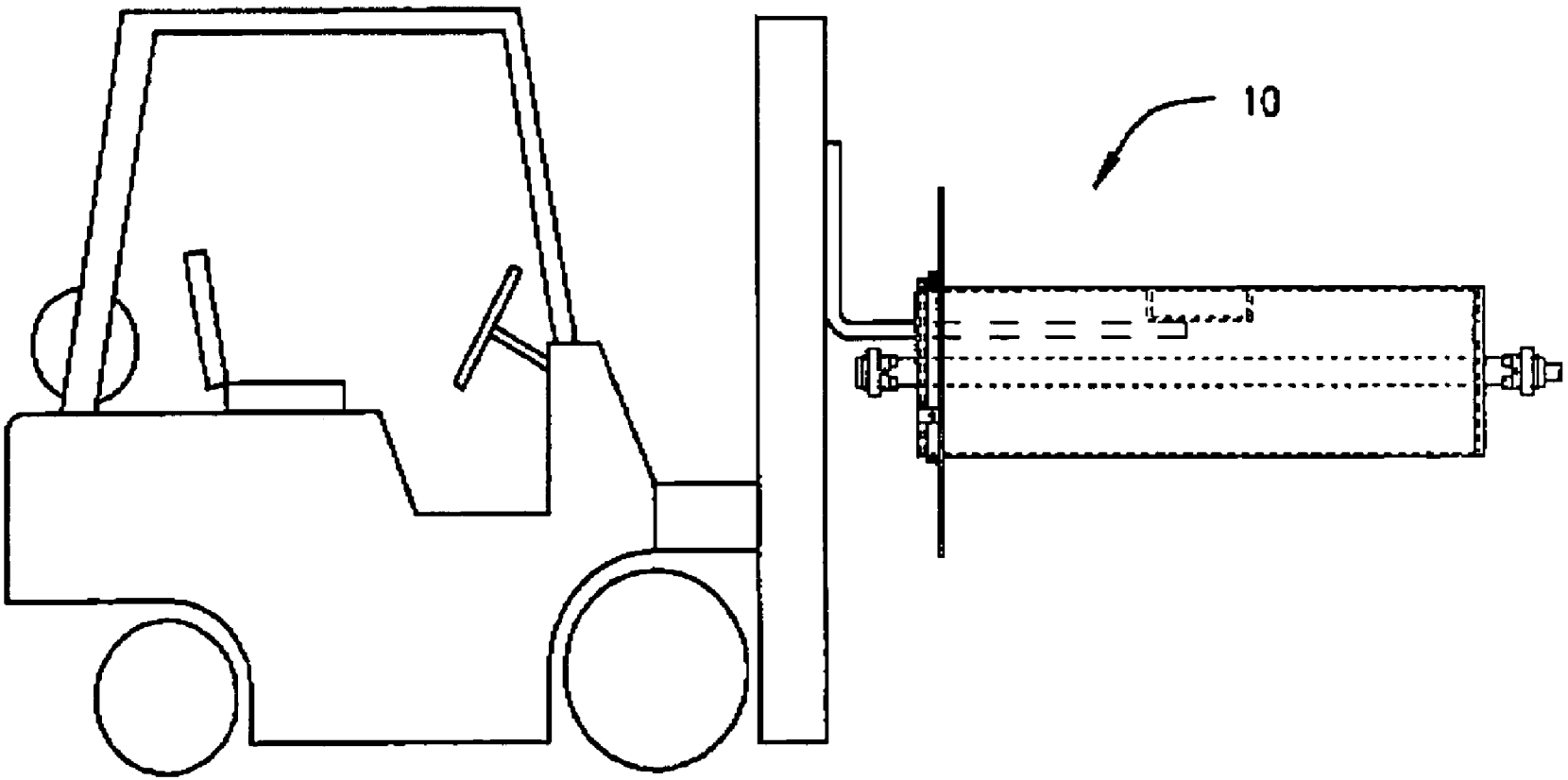
FIG. 6 is side plan view of the preferred embodiment shown with the improved coil handling assembly lifted by a conventional forklift and illustrating the improved coil handling assembly with the front coil stabilizer removed or alternatively, FIG. 6 could also be described as showing an alternate embodiment of the improved coil handling assembly lifted by a conventional forklift and illustrating an embodiment utilizing only one coil stabilizer.
Figure 7:
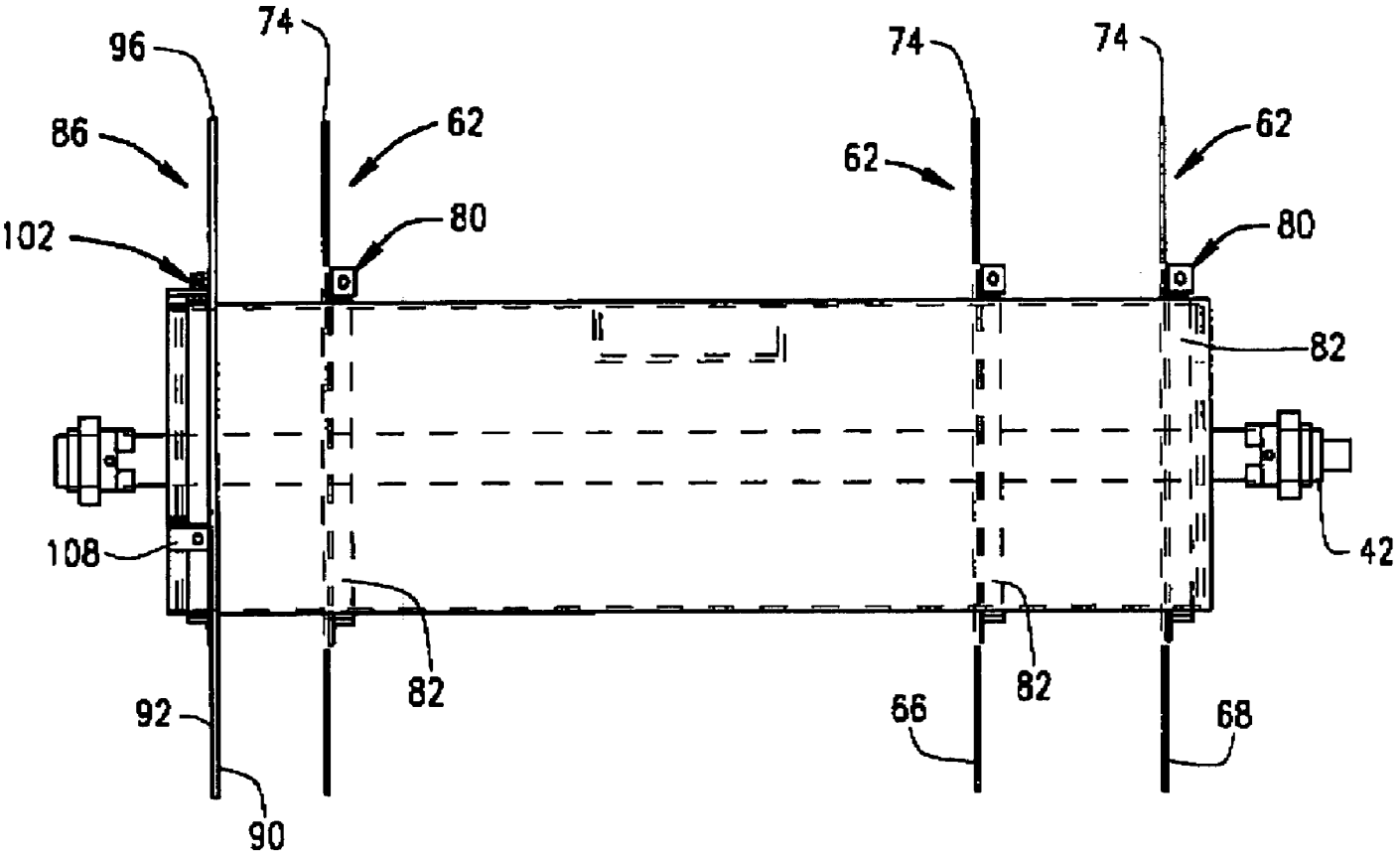
FIG. 7 is a side plan view of the preferred embodiment illustrating the movability and clamping member of the front coil stabilizer as shown in phantom.

Referring now to the drawings, there is shown in FIGS. 1-16 a preferred embodiment of the improved coil handling assembly 10 and method of manufacture which is especially suited for transport, storage, and processing of coiled material. The improved coil handling assembly comprises a cylindrical support member 12 having one or more shafts 42 held via a front and back end cover 26, 32 with one or more openings 28, 34 for ease of handling. When fully assembled, the improved coil handling assembly 10 further comprises a front and back coil stabilizer 62.

In a preferred embodiment, the present art improved coil handling assembly 10 comprises a cylindrical support member 12 capable of supporting the coiled material across the entire width of the coil. The cylindrical support member 12 has a front end 14, a back end 16, and a shaft 42 extending from both the front end 14 and the back end 16. A front bearing/support assembly 48 is attached to a front end extension 46 of the shaft 42 and a back bearing/support assembly 56 attached to a back end extension 54 of the shaft 42. A front coil stabilizer 62 and a back coil stabilizer 86, each having a retainer plate 64, 88 with a center aperture 72, 94 capable of receiving the cylindrical support member 12, are mounted upon said cylindrical support member 12. A clamping member 80, 102 having a circumferential band 82, 104 and a fastening means 84 or a clamping member 80, 102 having a circumferential band 82, 104 in combination with a fastening means 106 is at least partially attached to the retainer plate 64. The clamping member 80, 102 is thereby capable of receiving the cylindrical support member 12 and the fastening means 84, 106 is further capable of tightening and/or loosening with respect to the cylindrical support member 12 such that both the front 62 and back 86 coil stabilizers are removably attached and secured to the cylindrical support member 12.

The cylindrical support member 12 has a front end 14, a back end 16 opposite the front end 14, a middle portion 18 intermediate the front end 14 and the back end 16, and a center circular opening 24 extending completely through the cylindrical support member 12 from the front end 14 to the back end 16. The middle portion 18 further has an outer surface 20 and an inner surface 22 adjacent the center circular opening 24. The cylindrical support member 12 also comprises a front end cover 26 having a center aperture 30, the front end cover 26 attached to the front end 14 of the cylindrical support member 12, and a back end cover 32 having a center aperture 36, the back end cover 32 attached to the back end 16 of the cylindrical support member 12.

In the preferred embodiment, the front end cover 26 has at least one or more openings 28 and the back end cover 32 has at least one or more openings 34. At least one of the one or more openings 28 of the front end cover 26 and at least one of the one or more openings 34 of the back end cover 32 are shaped to receive an auxiliary lifting device such as the forks of a conventional forklift. In the preferred embodiment, the cylindrical support member 12 further comprises a stabilizing member 38 attached to the inner surface 22 of the cylindrical support member 12 approximately equidistant from the front end 14 and the back end 16 of the cylindrical support member 12 such that a first surface 39 of the stabilizing member 38 is in substantial alignment with a lifting surface at least one of the one or more openings 28, 34 which are shaped to receive an auxiliary lifting device such as the forks of a conventional forklift. At least one of the one or more openings 28 of the front end cover 26 and/or at least one of the one or more openings 34 of the back end cover 32 in combination with the stabilizing member 38 allows the improved coil handling or lifting device 10 to remain substantially stable and essentially level when lifted by the forks of a conventional forklift. In the preferred embodiment, the stabilizing member 38 has a semi-circular cross section 40 to simplify attachment to the inner surface of the cylindrical support member 12. Additional openings of the one or more openings 28, 34 of the front 26 and back 32 end covers are for weight reduction purposes such that the front end cover 26 and the back end cover 32 can be further described as having a spoke-like appearance.

In the preferred embodiment, the cylindrical support member 12 is initially fabricated as a pipe or tube with end covers 26, 32 thereby creating a drum-like member or a coil drum assembly. One embodiment of the preferred embodiment, as shown in the Figures, utilizes quarter inch thick steel welded into an eighteen inch outside diameter (OD) pipe or tube having a length of approximately sixty six inches. Another envisioned embodiment utilizes a pipe or tube having a length of approximately seventy eight inches. In other embodiments the aforesaid dimensions will vary. The front end cover 26 and the back end cover 32 are preferably welded to the front end 14 and back end 16, respectively, of the cylindrical support member 12 or pipe or tube yet may be attached using a plurality of methods including but not limited to bolts, screws, rivets, frictional press fits, and crimps.

Figure 8:
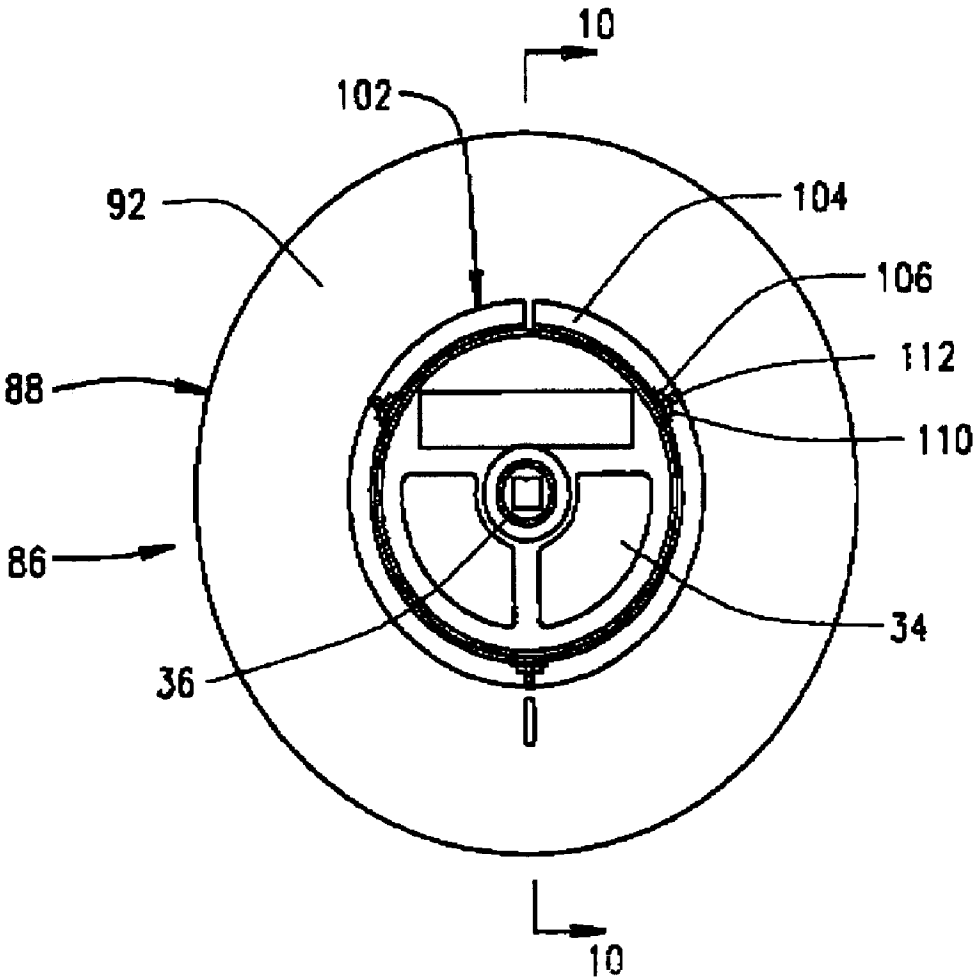
FIG. 8 is a back end plan view of the preferred embodiment illustrating the clamping member of the back coil stabilizer, one or more openings of the back end cover, all without the back bearing support assembly.
Figure 9:
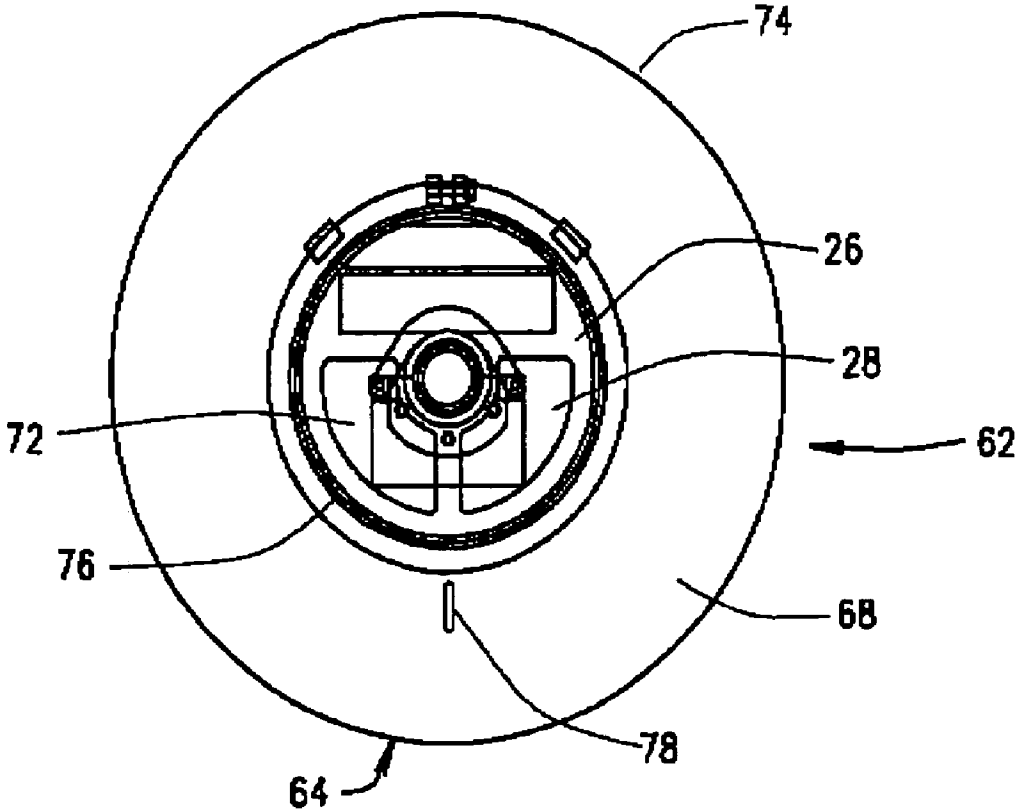
FIG. 9 is a front end plan view of the preferred embodiment illustrating the clamping member of the front coil stabilizer, one or more openings of the back end cover, all without the back bearing support assembly.
Figure 10:
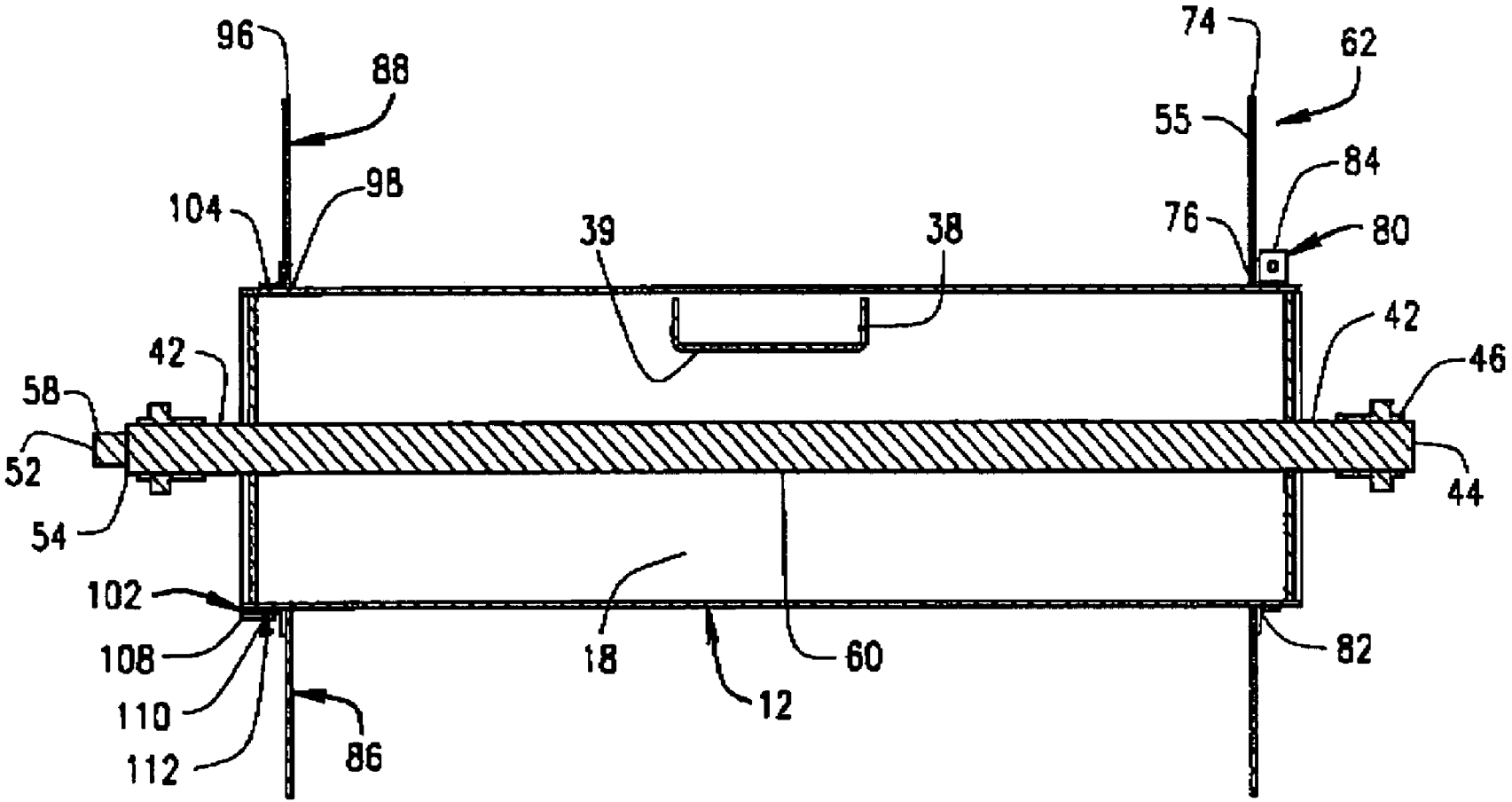
FIG. 10 is a cross sectional view taken along line 10-10 of FIG. 8 of the preferred embodiment of the improved coil handling assembly further illustrating the stabilizer member attached to the inner surface of the cylindrical support member, all without the bearing support assemblies.
Figure 11:
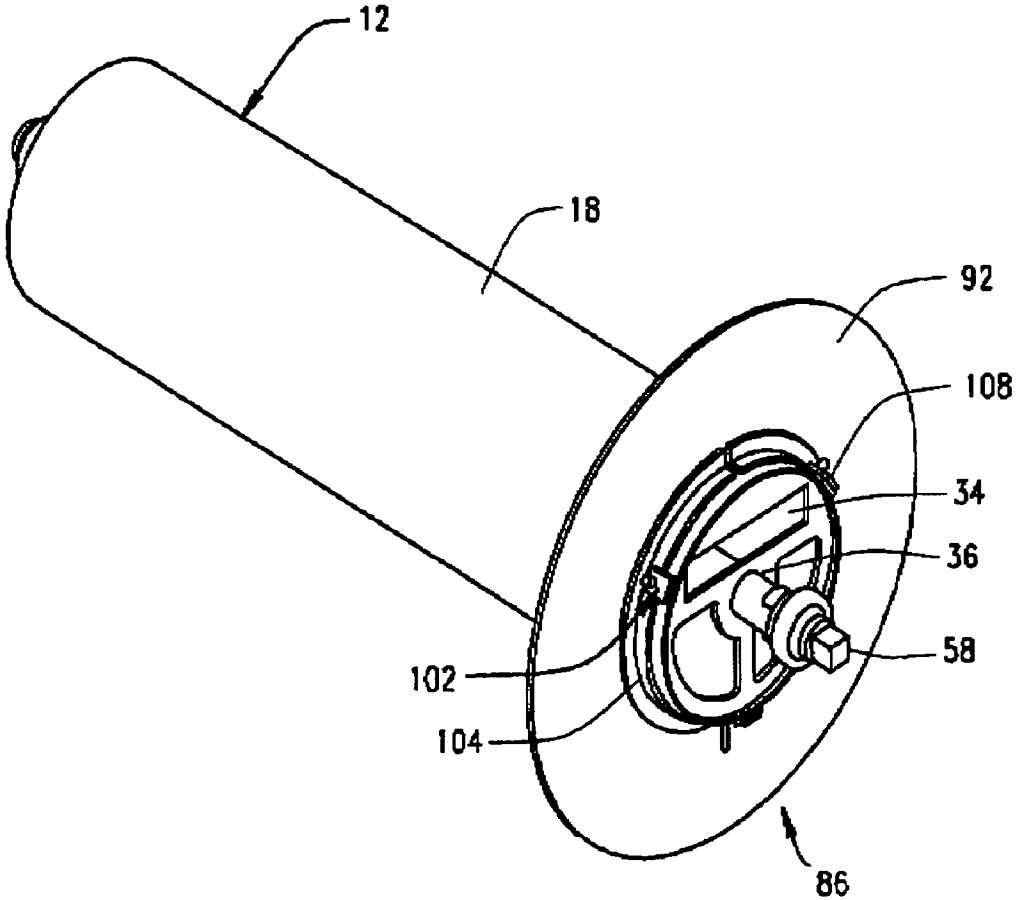
FIG. 11 is a back end perspective view of the preferred embodiment of the improved coil handling assembly without the front coil stabilizer attached further showing a square cross section drive shaft.
Figure 12:
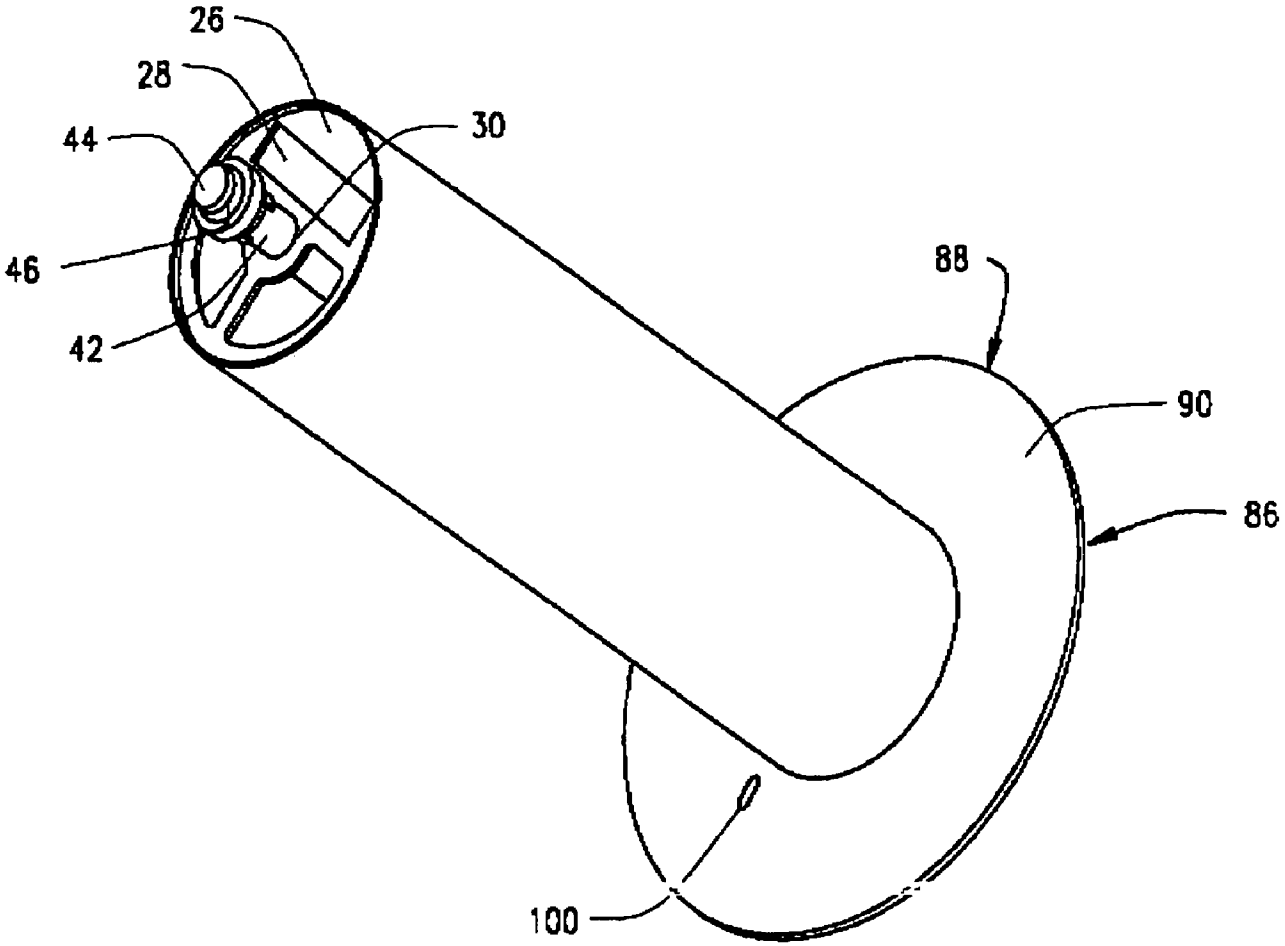
FIG. 12 is a front end perspective view of the preferred embodiment of the improved coil handling assembly without the front coil stabilizer attached.
Figure 13:
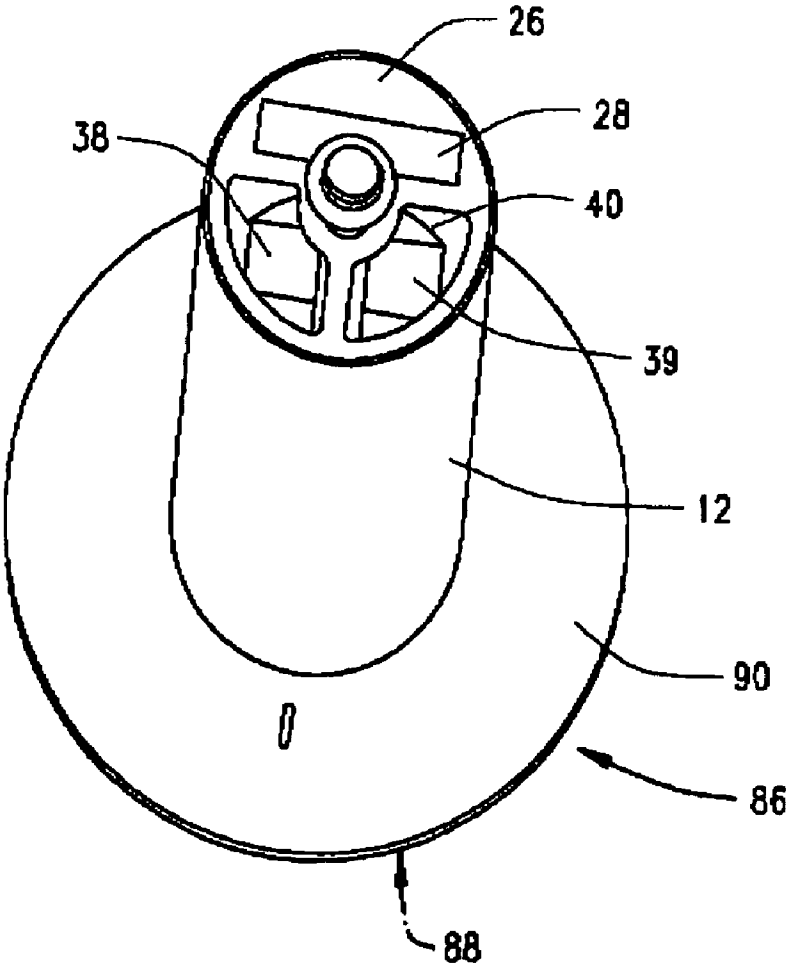
FIG. 13 a front end perspective view of the preferred embodiment of the improved coil handling assembly without the front coil stabilizer attached further illustrating the stabilizer member attached to the inner surface of the cylindrical support member.
Figure 14:
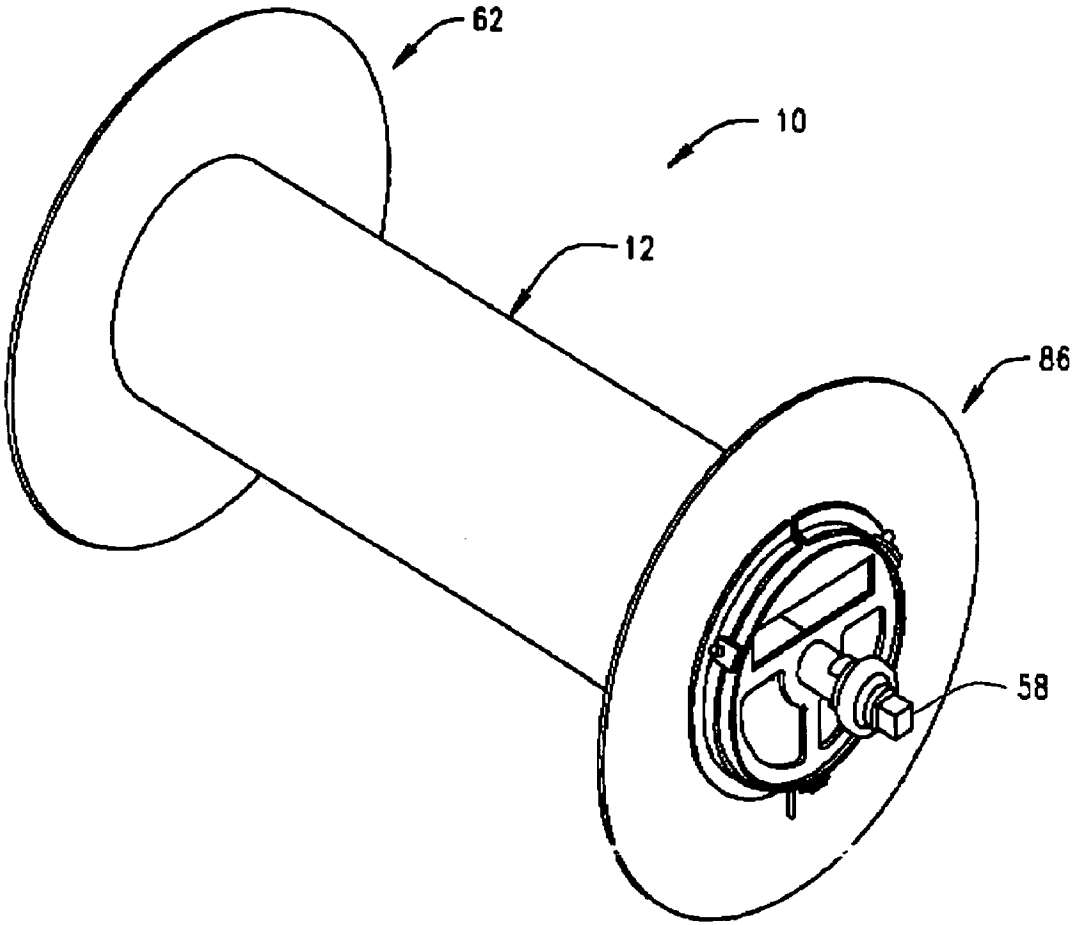
FIG. 14 is a back end perspective view of the preferred embodiment of the improved coil handling assembly with the front coil stabilizer attached further showing a square cross section drive shaft.
Figure 15:
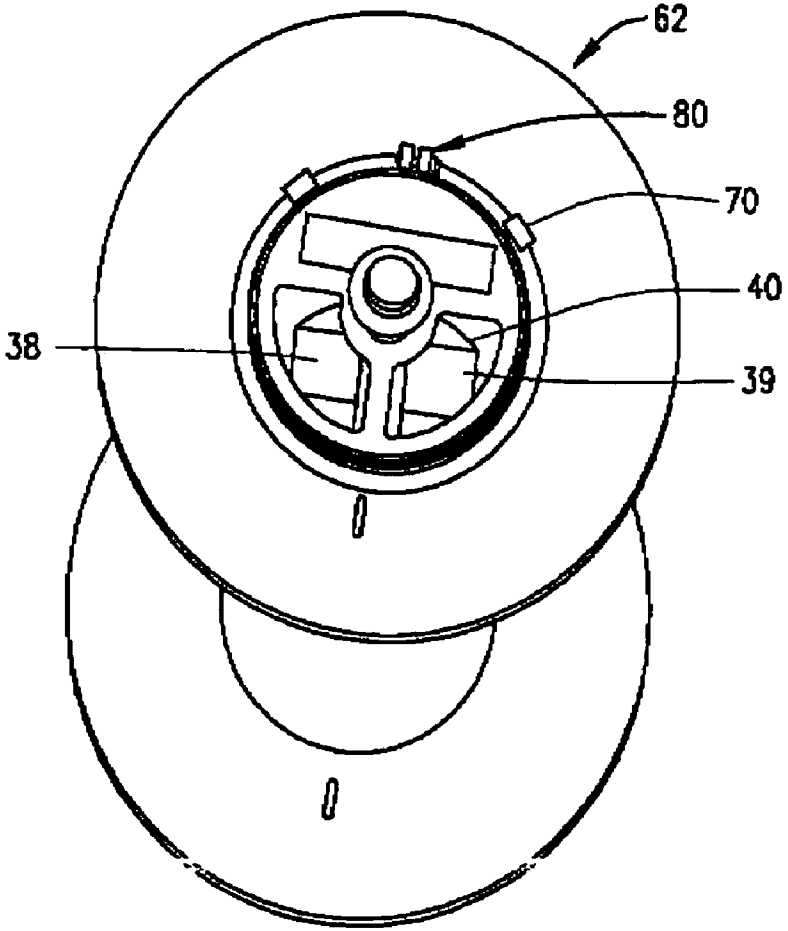
FIG. 15 is a front end perspective view of the preferred embodiment of the improved coil handling assembly with the front coil stabilizer attached also illustrating the stabilizer member attached to the inner surface of the cylindrical support member.
Figure 16:
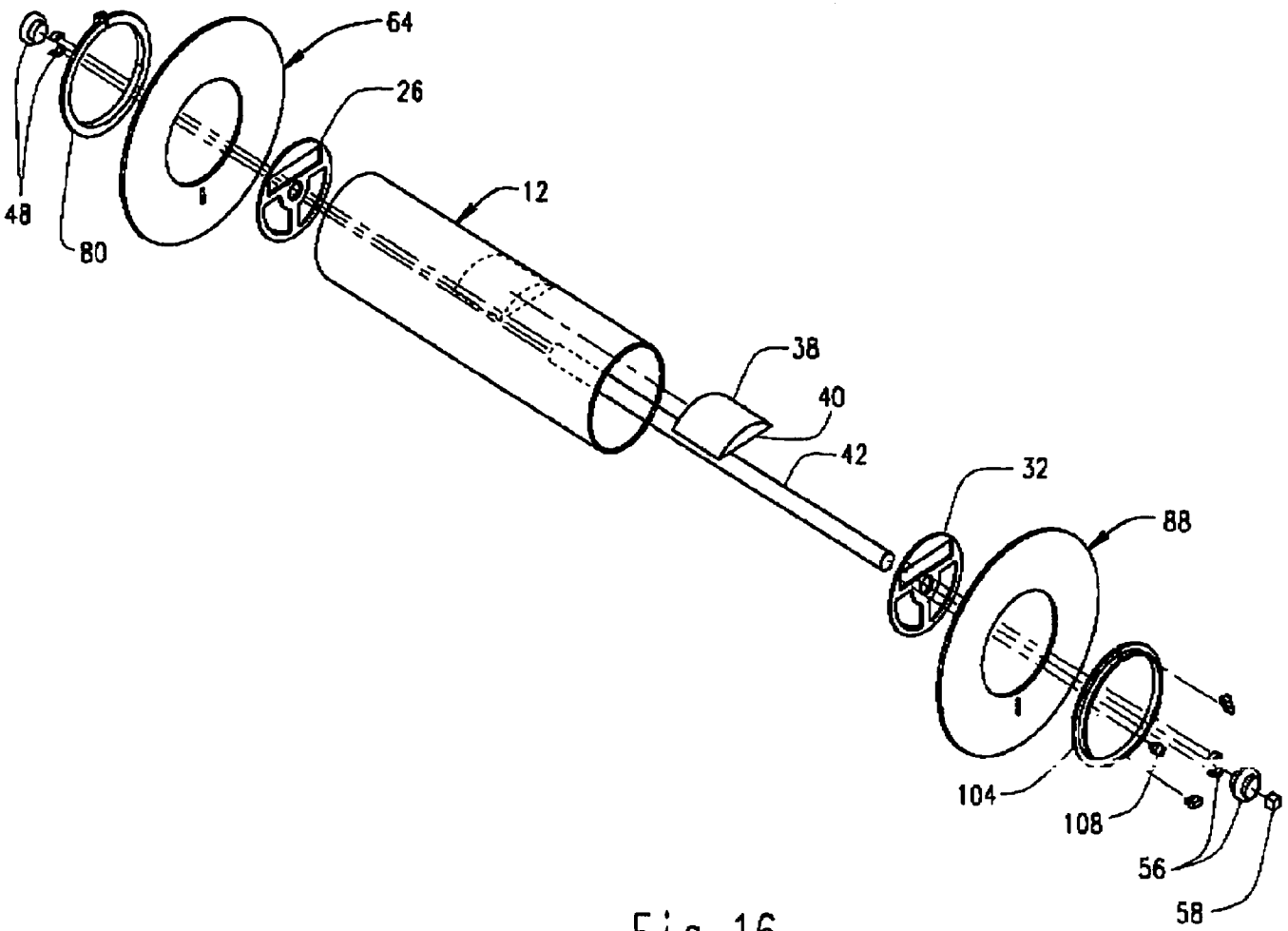
FIG. 16 is an exploded view of the preferred embodiment of the improved coil handling assembly.

The improved coil handling assembly 10 further comprises a shaft 42 having a front end 44, a back end 52 opposite the front end 44 and a middle portion 60 intermediate the front end 44 and the back end 52. The shaft 42 is capable of being at least partially received within the center opening 24 of the cylindrical support member 12 and extending completely through said opening 24 from the front end 14 to the back end 16 of the cylindrical support member 12. The shaft 42 also preferably extends completely through the center aperture 30 of the front end cover 26 and the center aperture 36 of the back end cover 32 such that when received, both the front end 44 and the back end 52 of the shaft 42 extend out of the opening of the cylindrical support member 12. That is, the shaft 42 extends from the respective center openings or apertures 30, 36 of both the front end cover 26 and the back end cover 32 such that said middle portion 60 of the shaft 42 has a front end extension 46 and a back end extension 54 extending from said cylindrical support member 12. The shaft 42 is also preferably attached to both the front end cover 26 and the back end cover 32 of the cylindrical support member 12 such that when the shaft 42 rotates, the cylindrical support member 12 also rotates. In one embodiment of the preferred embodiment, as shown in FIGS. 8, 11, & 14, the shaft 42 is cylindrical, approximately eighty inches long with a diameter of approximately three inches which approximately corresponds to the diameter of the center apertures 30, 36 of both the front end cover 26 and the back end cover 32. The shaft 42 is preferably welded to both the front end cover 26 and the back end cover 32. Alternative embodiments may utilize more than one shaft 42 or a split shaft 42 attached at the covers 26, 32 with or without the middle portion 60.

The improved coil handling assembly 10 also comprises a front bearing/support assembly 48 attached to the front end extension 46 of the shaft 42 and a back bearing/support assembly 56 attached to the back end extension 54 of the shaft 42. The back bearing/support assembly 56 and/or the front bearing/support assembly 48, and/or preferably the shaft front end extension 46 and/or shaft back end extension 54, further have a drive shaft 58 capable of being connected to a motor assembly in a processing line. Preferably, the drive shaft 58 having a square cross section The improved coil handling assembly 10 further comprises a front coil stabilizer 62 and a back coil stabilizer 86. The front coil stabilizer 62 comprises a retainer plate 64 with a front inner surface 66, a front outer surface 68, and a center aperture 72 extending from the front inner surface 66 to the front outer surface 68. The center aperture 72 is capable of receiving the cylindrical support member 12. The front coil stabilizer 62 further comprises an outer edge 74, an inner edge 76 adjacent the center aperture 72, and a front clamping member 80 having an angled circumferential band 82 and front fastening means 84.

In the preferred embodiment, the clamping member 80 of the front coil stabilizer 62 is a split angled circumferential band 82 at least partially attached to the front outer surface 68 of the retainer plate 64 adjacent the inner edge 76 such that the clamping member 80 is essentially perpendicular to the front outer surface 68 of the retainer plate 64 and capable of receiving the cylindrical support member 12. The split angled circumferential band 82 is also at least partially attached to the front outer surface 68 of the retainer plate 64 such that the fastening means 84 is capable of tightening and/or loosening said band 82 in order that the front coil stabilizer 62 can be removably attached and secured to the cylindrical support member 12.

In the aforesaid preferred embodiment, the retainer plate 64 further has one or more stops or retainers 70 attached to the front outer surface 68 adjacent the clamping member 80 such that the stops 70 effectively prevent the unattached portion of the split angled circumferential band 82 from springing loose when the fastening means 84 are loosened. Preferably, the fastening means 84 is a threaded nut and bolt combination attached to the angled circumferential band 82 adjacent to the split but may comprise a plurality of fasteners including but not limited to clamps, rivets, screws, and dowels.

As shown in the Figures, the center aperture 72 of the preferred embodiment of the front coil stabilizer's 62 retainer plate 64 is approximately eighteen inches in diameter which approximately corresponds with the diameter of the cylindrical support member 12. Preferably, the front coil stabilizer's 62 retainer plate 64 is circular and also has one or more observation openings 78 extending from the front inner surface 66 to the front outer surface 68 such that it is possible to observe the remaining amount of material still wound in the coil. Preferably, the clamping member 80 of the front coil stabilizer 62 is partially attached or welded to the outer surface 68 of the front coil stabilizer's 62 retainer plate 64 such that the split angled circumferential band 82 is still capable of at least partial movement whereby the fastening means 84 can tighten and/or loosen the clamping member 80 with respect to the cylindrical support member 12 such that the front coil stabilizer 62 can be removably attached and secured to or with the cylindrical support member 12.

The back coil stabilizer 86 comprises a retainer plate 88 with a back inner surface 90, a back outer surface 92, and a center aperture 94 extending from the back inner surface 90 to the back outer surface 92. The center aperture 94 is capable of receiving the cylindrical support member 12. The back coil stabilizer 86 further comprises an outer edge 96, an inner edge 98 adjacent the center aperture 94, and a back clamping member 102 comprising an angled circumferential band 104 in combination with separate back fastening means 106.

In the preferred embodiment, the clamping member 102 of the back coil stabilizer 86 is an angled circumferential band 104 attached to the back outer surface 92 of the retainer plate 88 adjacent the inner edge 98 such that the clamping member 102 is essentially perpendicular to the back outer surface 92 of the retainer plate and capable of receiving the cylindrical support member 12. The angled circumferential band 104 is also attached to the back outer surface 92 of the retainer plate 88 such that the back fastening means 106 is capable of tightening and/or loosening the clamping member 102 with respect to the cylindrical support member 12 in order that the back coil stabilizer 86 can be removably attached and secured to or with the cylindrical support member 12.

In this preferred embodiment, the back fastening means 106 comprises one or more substantially L-shaped members 108 having a threaded aperture 110 in combination with a threaded member 112 such as a bolt. The one or more substantially L-shaped members 108 are attached to the outer surface 20 of the middle portion 18 of the cylindrical support member 12 adjacent the back end 16. A portion of the one or more L-shaped members 108 functions as a stop which effectively serves as an alignment point for the back coil stabilizer 86 and adds strength and stability to the clamping member 102. As such, in this preferred embodiment the back coil stabilizer 86, while moveable and therefore adjustable, is not removable from the back end 16 of the cylindrical support member 12 but rather can only be removed from the front end 14 of the cylindrical support member 12.

Also in the aforesaid preferred embodiment, the center aperture 94 of the retainer plate 88 of the back coil stabilizer 86 is also approximately eighteen inches in diameter which approximately corresponds with the diameter of the cylindrical support member 12. Preferably, the back coil stabilizer's 86 retainer plate 88 is circular and also has one or more observation openings 100 extending from the back inner surface 90 to the back outer surface 92 such that it is possible to observe the remaining amount of material still wound in the coil.

The angled circumferential band 104 of the back coil stabilizer 86 is preferably attached via welding to the outer surface 92 of the back coil stabilizer's 86 retainer plate 88 in order that the threaded member 112 of the fastening means 106 is capable of contacting the angled circumferential band 104 such that when the fastening means 106 is tightened, the threaded member 112 can apply sufficient pressure or force to prevent substantial movement of the back coil stabilizer 86. The angled circumferential band 104 in combination with the fastening means 106 is capable of tightening and/or loosening the clamping member 102 such that the back coil stabilizer 86 can be removably attached and secured to or with the cylindrical support member 12. Said fastening means 106 may further comprise a plurality of fasteners or retainers including but not limited to pins, dowels, frictional fits, clamps, or stops.

In an alternate embodiment, the one or more substantially L-shaped members 108 are removed from the outer surface 20 of the cylindrical support member 12. In this alternate embodiment, two front coil stabilizers 62 are utilized instead of the preferred embodiment of the back coil stabilizer 86. In this alternate embodiment, one of the front coil stabilizers 62 is merely flipped around and attached near the back end 16 of the cylindrical support member 12 and positioned where the back coil stabilizer 86 would have been positioned in the preferred embodiment.

In yet another alternate embodiment, only one coil stabilizer 86, 62 is utilized. As such, either the preferred embodiment of the front coil stabilizer 62 or the preferred embodiment of the back coil stabilizer 86 could be provided and utilized as the one coil stabilizer.

In operation or use, the fastening means 84, 106 can be loosened thereby loosening the clamping member 80, 102 such that the coil stabilizers 62, 86 can be removed. It is typically necessary to remove only the front coil stabilizer 62 when loading a coil for use on an edge guided processing line. If the coil is processed on a center guided processing line and the width of the processed coil changes, the back coil stabilizer 86 must be at least loosened whereby the coil can be centered on the cylindrical support member 12 and subsequently secured.

For example, with the preferred embodiment, the clamping member 80 of the front coil stabilizer 62 is quickly loosened and simply removed from the front end 14 of the cylindrical support member 12. A conventional fork lift inserts a set of closed forks into the at least one or more openings 34 of the back end cover 32 and lifts the entire improved coil handling assembly 10 (absent the removed front coil stabilizer). Since the assembly 10 remains essentially level when lifted, the forklift simply inserts the improved coil handling assembly 10 into the ID of a coif, from either the front edge side of the coil or the back edge side of the coil. The front coil stabilizer 62 can then be reattached to provide additional stability. The fork lift is now capable of lifting the improved coil handling assembly 10 such that the cylindrical support member 12 now supports the coils weight across the entire width of the coil. The improved coil handling assembly 10 and coil combination can now be transported for placement such that both the front bearing/support assembly 48 and the back bearing/support assembly 56 support the improved coil handling assembly 10 and coil combination in order that the coil can be rotated to wind/unwind the coiled material.

From the foregoing description, those skilled in the art will appreciate that an improved coil handling assembly 10 and method of manufacture has been shown and described. The art represents a quick, easy, safe, and cost effective way to transport, store, and utilize coiled material without the complexities and inconveniences of the prior art.

Having described the invention in detail, those skilled in the art will appreciate that all the objects of the present invention are realized and that modifications may be made to the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. An improved coil handling assembly for supporting and transporting coiled material comprising:

a cylindrical support member of a diameter less than a coil inside diameter having a front end, a back end, a middle portion, and one or more openings in said front end or said back end for receiving an auxiliary lifting device, the cylindrical support member being configured to support the coiled material across substantially its entire length;

a front end extension shaft extending from said cylindrical support member front end, and a back end extension shaft extending from said cylindrical support member back end;

one or more coil stabilizers comprising a retainer plate having an inner surface, an outer surface, an inner edge, an outer edge, and an aperture capable of receiving said cylindrical support member, said inner edge being adjacent said aperture; and a clamping member capable of receiving and attaching to said cylindrical support member such that one or more of said coil stabilizers can be removably secured to said cylindrical support member, at least one of said coil stabilizers being slidably removably attachable to said cylindrical support member along substantially its entire length.

2. The improved coil handling assembly as described in claim 1, further comprising:

a stabilizing member having a first surface in substantial alignment with a lifting surface of at least one of said one or more openings.

3. The improved coil handling assembly as described in claim 2 wherein one or more of said extension shafts further includes one or more drive shafts.

4. The improved coil handling assembly as described in claim 2, further comprising:

a front bearing assembly attached with said front end extension shaft and a back bearing assembly attached with said back end extension shaft.

5. The improved coil handling assembly as described in claim 2 wherein:

said cylindrical support member further comprises:

a center circular opening;

an inner surface substantially adjacent said center circular opening;

an outer surface substantially adjacent said center circular opening;

a front end cover attached to said front end of said cylindrical support member; and a back end cover attached to said back end of said cylindrical support member; and said one or more openings for receiving an auxiliary lifting device are substantially within said front end cover or said back end cover.

6. The improved coil handling assembly as described in claim 5 wherein:

said stabilizing member is attached to said inner surface of said cylindrical support member.

7. The improved coil handling assembly as described in claim 6 wherein:

said stabilizing member has a substantially semicircular cross section.

8. The improved coil handling assembly as described in claim 5 wherein:

said front end extension shaft and said back end extension shaft comprise a substantially single shaft having a middle portion and extending through a first substantially center aperture in said front end cover and a second substantially center aperture in said back end cover.

9. The improved coil handling assembly as described in claim 5 wherein:

said clamping member comprises a circumferential band attached with said coil stabilizer, and further comprising;

a fastening means comprising one or more substantially L-shaped members attached to said outer surface of said cylindrical support member and capable of tightening or loosening said clamping member with respect to said cylindrical support member.

10. The improved coil handling assembly as described in claim 5 wherein:

said clamping member comprises a split angled circumferential band at least partially attached to said outer surface or said inner surface of said coil stabilizer and having a fastening means.

11. The improved coil handling assembly as described in claim 1, further comprising:

a front bearing assembly attached with said front end extension shaft and a back bearing assembly attached with said back end extension shaft.

12. The improved coil handling assembly as described in claim 1 wherein:

said cylindrical support member further comprises a center circular opening and an inner surface substantially adjacent said center circular opening and an outer surface substantially adjacent said center circular opening;

a front end cover attached to said front end of said cylindrical support member; and a back end cover attached to said back end of said cylindrical support member; and said one or more openings for receiving an auxiliary lifting device are substantially within said front end cover or said back end cover.

13. The improved coil handling assembly as described in claim 1 wherein:

said clamping member comprises a split angled circumferential band having a fastening means.

14. The improved coil handling assembly as described in claim 13 wherein:

said split angled circumferential band is at least partially attached to said outer surface or said inner surface of said coil stabilizer.

15. The improved coil handling assembly as described in claim 13 wherein:

one or more of said coil stabilizers having one or more observation openings.

16. The improved coil handling assembly as described in claim 1 wherein:

one or more of said coil stabilizers have one or more observation openings.

17. The improved coil handling assembly as described in claim 1 wherein:

said clamping member comprises a circumferential band attached with said coil stabilizer, and further comprising;

a fastening means comprising one or more substantially L-shaped members attached to said cylindrical support member and capable of tightening or loosening said clamping member with respect to said cylindrical support member.

18. An improved coil handling assembly for supporting and transporting coiled material comprising:

a cylindrical support member of a diameter less than a coil inside diameter having a front end, a back end, a middle portion, and a center opening extending therethrough, the cylindrical support member being configured to support the coiled material across substantially its entire length;

a front end cover substantially attached to said front end;

a back end cover substantially attached to said back end;

one or more openings to receive an auxiliary lifting device in said front end cover or said back end cover;

a front end extension shaft extending from said cylindrical support member and from said front end cover;

a back end extension shaft extending from said cylindrical support member and from said back end cover;

at least one of said front and back end extension shafts being exposed and adapted for connection to a motor assembly;

one or more coil stabilizers comprising a retainer plate having an inner surface, an outer surface, an aperture extending from said inner surface to said outer surface and capable of receiving said cylindrical support member, an outer edge, and an inner edge adjacent said aperture; and one or more clamping members capable of removably securing the cylindrical support member with said one or more coil stabilizers.

19. The improved coil handling assembly as described in claim 18, further comprising:

a stabilizing member attached to said inner surface of said cylindrical support member and having a first surface in substantial alignment with at least one or more of said openings.

20. The improved coil handling assembly as described in claim 19 wherein:

said one or more coil stabilizers comprise a front coil stabilizer and a back coil stabilizer; and said clamping member capable of removably securing said front coil stabilizer having a split angled circumferential band at least partially attached to one or more of said surfaces of said front coil stabilizer and a front fastening means capable of tightening or loosening said clamping member with respect to said cylindrical support member such that said front coil stabilizer can be removably attached and secured to said cylindrical support member; and said clamping member capable of removably securing said back coil stabilizer having a circumferential band attached with one or more of said surfaces of said back coil stabilizer and one or more members attached to said outer surface of said cylindrical support member adjacent said back end of said cylindrical support member and said one or more members having a back fastening means contacting said circumferential band to substantially prevent movement of said back coil stabilizer.

* * * * *